US009334094B2

(12) United States Patent
Zacard

(10) Patent No.: US 9,334,094 B2
(45) Date of Patent: May 10, 2016

(54) RESEALABLE PACKAGING DEVICE AND METHOD FOR PACKAGING COLLECTIBLE ITEMS

(76) Inventor: Patrick Zacard, Blainville (CA)

( * ) Notice: Subject to any disclaimer, the term of this patent is extended or adjusted under 35 U.S.C. 154(b) by 952 days.

(21) Appl. No.: 13/460,227

(22) Filed: Apr. 30, 2012

(65) Prior Publication Data

US 2013/0067866 A1 Mar. 21, 2013

(30) Foreign Application Priority Data

Sep. 19, 2011 (GB) ..... 1116168.4

(51) Int. Cl.
*B65B 11/00* (2006.01)
*B65D 73/00* (2006.01)
*B65D 85/58* (2006.01)

(52) U.S. Cl.
CPC ..... *B65D 73/0057* (2013.01); *B65D 73/00* (2013.01); *B65D 85/58* (2013.01)

(58) Field of Classification Search
CPC ..... B65D 73/00; B65D 73/0035; B65D 73/0057; B65D 73/0092; B65D 73/0042; B65D 85/58
USPC ..... 53/461, 485, 452; 493/264; 206/0.8, 206/0.84, 769, 775, 462, 467, 0.82; 220/4.07
See application file for complete search history.

(56) References Cited

U.S. PATENT DOCUMENTS 2,061,139 A * 11/1936 Alfred ..... 206/489
2,258,535 A * 10/1941 Buranelli ..... 206/0.84
2,352,319 A * 6/1944 Harris ..... 206/539
3,047,144 A * 7/1962 Wissel ..... 206/0.83
3,052,344 A * 9/1962 Frank ..... 206/0.82
3,127,993 A * 4/1964 Phipps ..... 206/484
3,139,977 A * 7/1964 Burdick ..... 206/0.83
3,229,809 A * 1/1966 Spadaro ..... 206/0.82
3,519,128 A * 7/1970 Swanberg ..... 206/771
3,635,335 A * 1/1972 Kramer ..... 206/0.82
3,762,544 A * 10/1973 Matthews ..... B65D 73/0057 206/45.28
3,788,464 A * 1/1974 Skinner ..... 206/0.82
4,063,639 A * 12/1977 Grant ..... 206/0.82
4,091,927 A * 5/1978 Lunsford ..... 206/459.5
4,165,573 A * 8/1979 Richards ..... 40/661
4,402,399 A * 9/1983 Friess ..... 206/0.83
4,466,534 A * 8/1984 Dunn ..... 206/777
4,499,353 A * 2/1985 Shields ..... 206/470
4,739,883 A * 4/1988 Mohs ..... B65D 73/00 206/461
5,033,774 A * 7/1991 Benardelli ..... A45C 11/24 206/0.82
5,133,451 A * 7/1992 Boyd et al. ..... 206/0.81
5,191,972 A * 3/1993 Helzer et al. ..... 206/0.84
5,318,808 A * 6/1994 Crivello et al. ..... 427/517
5,691,052 A * 11/1997 Jones ..... B32B 27/08 428/349
6,029,807 A * 2/2000 Love ..... A47G 1/12 206/0.82
6,050,415 A * 4/2000 Lind et al. ..... 206/462
6,074,731 A * 6/2000 Wilkie ..... B32B 27/32 428/215
6,076,675 A * 6/2000 Pawlowski ..... 206/459.5
6,615,986 B2 * 9/2003 Pirro et al. ..... 206/704

(Continued)

*Primary Examiner* — Michelle Lopez
*Assistant Examiner* — Eduardo R Ferrero
(74) *Attorney, Agent, or Firm* — Robert Brouillette; Brouillette & Partners

(57) ABSTRACT

A resealable packaging device comprises a frame having a combination of multiple layers made of opaque material, each opaque layer comprising one ore more apertures for insertion of a display container. The display container comprises a removable transparent cover or cap surrounded by rigid opaque material allowing one or more items to be sealed within the display container. A method for packaging at least one object is also disclosed.

20 Claims, 4 Drawing Sheets

(56) References Cited

U.S. PATENT DOCUMENTS

| | | | | |
|---|---|---|---|---|
| 7,100,761 | B2 * | 9/2006 | Helzer et al. | 206/0.8 |
| 7,837,031 | B2 * | 11/2010 | Counts | 206/0.84 |
| 8,091,704 | B2 * | 1/2012 | Trigg | 206/469 |
| 8,708,146 | B2 * | 4/2014 | Falcon | 206/467 |
| 2004/0069673 | A1 * | 4/2004 | Dinges | 206/484 |
| 2004/0182735 | A1 * | 9/2004 | Lombardi et al. | 206/461 |
| 2005/0150780 | A1 * | 7/2005 | Pleven | 206/0.82 |
| 2006/0138009 | A1 * | 6/2006 | Bozkurt | 206/467 |
| 2006/0194054 | A1 * | 8/2006 | Angela et al. | 428/400 |
| 2006/0278539 | A1 * | 12/2006 | Fager | 206/0.82 |
| 2007/0051652 | A1 * | 3/2007 | Tilton | 206/462 |
| 2007/0151893 | A1 * | 7/2007 | Barndt et al. | 206/531 |
| 2007/0187264 | A1 * | 8/2007 | Hofte et al. | 206/45.24 |
| 2008/0142393 | A1 * | 6/2008 | Grosskopf | 206/462 |
| 2009/0038977 | A1 * | 2/2009 | Tilton | 206/469 |
| 2009/0145952 | A1 * | 6/2009 | Dear | 229/5.84 |
| 2010/0011635 | A1 * | 1/2010 | Sipe et al. | 40/124.06 |
| 2010/0084289 | A1 * | 4/2010 | Willms et al. | 206/84 |
| 2010/0126895 | A1 * | 5/2010 | Smith et al. | 206/461 |
| 2010/0176019 | A1 * | 7/2010 | Heller | 206/461 |
| 2010/0193392 | A1 * | 8/2010 | Karow | 206/462 |
| 2012/0145565 | A1 * | 6/2012 | Sottile | 206/8 |
| 2013/0067866 | A1 * | 3/2013 | Zacard | 53/461 |
| 2013/0232920 | A1 * | 9/2013 | Kasparian | A45C 11/00 53/467 |
| 2016/0007771 | A1 * | 1/2016 | Schoeler | A47G 1/12 206/775 |
| 2016/0007772 | A1 * | 1/2016 | Schoeler | A47G 1/12 206/775 |

* cited by examiner

RESEALABLE PACKAGING DEVICE AND METHOD FOR PACKAGING COLLECTIBLE ITEMS

CROSS-REFERENCE TO RELATED APPLICATIONS

The present patent application claims the benefits of priority of United Kingdom Patent Application no. GB1116168.4, entitled "Accessible window display device for at least one object" and filed at the United Kingdom Intellectual Property Office on Sep. 19, 2011.

FIELD OF THE INVENTION

The present invention generally relates to packaging of article allowing the display of such article and particularly to devices having at least one window and to a method for packaging collectible items.

BACKGROUND OF THE INVENTION

Packaging for collectible article such as coins, cards, hairs, medals, or small quantities of precious ore or soil have been used and seen on the market for many years, and even decades. Over the years, many methods have been developed to display a collectible in a package. As examples, the collectible may be snapped in or on a paper board, sandwiched between two layers of flexible material or sealed in a plastic container or bubble.

U.S. patent application published under no. U.S. 2010/0084289, filed Aug. 14, 2009 and entitled "Coin storage and display device", discloses a coin storage and display device allowing the display of article using a plastic sheet comprising one or more retaining structure. This invention is limited to display one or more articles having planar sides, such as coins or medallions. Furthermore, the snapping mechanism prevents the sealing of the article within a package.

U.S. Pat. No. 7,100,761 (referred as "'761"), filed on Sep. 5, 2006 and entitled "Rotatable coin display", discloses a display for collectible item which may be rotated and where the display comprises a bubble made of semi-rigid transparent material. The '761 patent allows the item to be permanently sealed within the bubble while allowing rotation of the said bubble. However, the collectible item being permanently sealed implies that the item must be inserted within the display at the time of manufacturing the packaging. Also, the rotatable display limits the shape of the display container to a generally circular shape, thus limiting the collectible items to coins, rounded medallions and other items fitting in a generally circular shape. Furthermore, a user is not able to open and access the collectible item contained in the display bubble.

There is a need for a display device for preserving one or more collectible items which mitigates at least some shortcomings of prior art display devices.

SUMMARY OF THE INVENTION

One of the aspects of the present invention is to provide a resealable package for one or more collectible items, wherein the package comprises a typically transparent capsule or container having a removable top part allowing the content to be accessed or removed or to be replaced by new content.

A further apsect of the present invention is to provide a package for one or more collectible items having any peripheral shape such as circular, rectangular, pentagonal or any other custom shape.

Another aspect of the present invention is to provide a method for packaging collectible items, wherein such method may allow a retailer, manufacturer or customer of collectible items to place one or more item in the package while being able to seal the package.

In order to do realize the foregoing and other aspects, the present invention generally comprises a capsule comprising a base portion and a cover configured to display an object, wherein the base portion and the cover are configured to be sealingly mounted together and wherein the cover is made of transparent material, at least two padding layers comprising at least one aperture, at least one covering film layer, at least one adhesive layer and at least one cover layer. In this embodiment, the at least two padding layers, the at least one covering film layer, the at least one adhesive layer and the at least one cover layer are affixed together.

In another embodiment, the packaging device for displaying at least one object comprises a capsule comprising a base portion and a cover configured to display an object, wherein the base portion and the cover are configured to be sealingly yet removably mounted together and wherein the cover is made of transparent material. The packaging further comprises two padding layers comprising at least one aperture wherein the packaging device comprises two superposed padding layers, a bottom padding layer and a top padding layer, the aperture of the bottom padding layer is configured to allow the peripheral delimitation and the surface of the flange of the capsule to tightly fit into the aperture of the bottom padding layer, the surface of the aperture of the top padding layer is generally inferior to the aperture of the bottom layer.

Furthermore, the packaging device comprises at least one covering film layer made of a polypropylene film, at least one heat activated adhesive layer and at least one cover layer made with a material allowing to be printed on. The at least two padding layers, the at least one covering film layer, the at least one adhesive layer and the at least one cover layer are affixed together.

In a further embodiment, a method for packaging at least one object using a packaging device comprising a capsule comprising a base portion and a cover configured to display an object, at least two padding layers comprising at least one aperture, at least one covering film layer, at least one adhesive layer and at least one cover layer wherein the at least two padding layers, the at least one covering film layer, the at least one adhesive layer and the at least one cover layer are affixed together. The method for packaging comprises the steps for bonding the at least two padding layers together using a sealing adhesive, in such a way that the apertures of each padding layer are centrally aligned, for adding at least one covering film layer by applying to the at least two padding layers an adhesive and at least one covering film, for applying at least one adhesive layer on the at least one covering film layer, for centrally aligning the at least one aperture of the at least one cover layer with the at least one aperture of the bonded padding layers, for bonding the at least one cover layer to the package, for inserting the at least one object in the capsule and for securing the cover through the aperture of the at least one cover layer where the capsule is installed.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel resealable packaging device and method for packaging collectible items will be described hereinafter. Although the invention is described in terms of specific illustrative embodiment(s), it is to be understood that the embodiment(s) described herein are by way of example only and that the scope of the invention is not intended to be limited thereby.

A resealable packaging device in accordance with the present invention generally comprises a frame having a combination of multiple layers made of opaque material, each opaque layer comprising one ore more apertures for insertion of a display container. The display container comprises a removable transparent cover or cap surrounded by rigid opaque material allowing one or more collectible items to be sealed within the display container.

Figure 1:
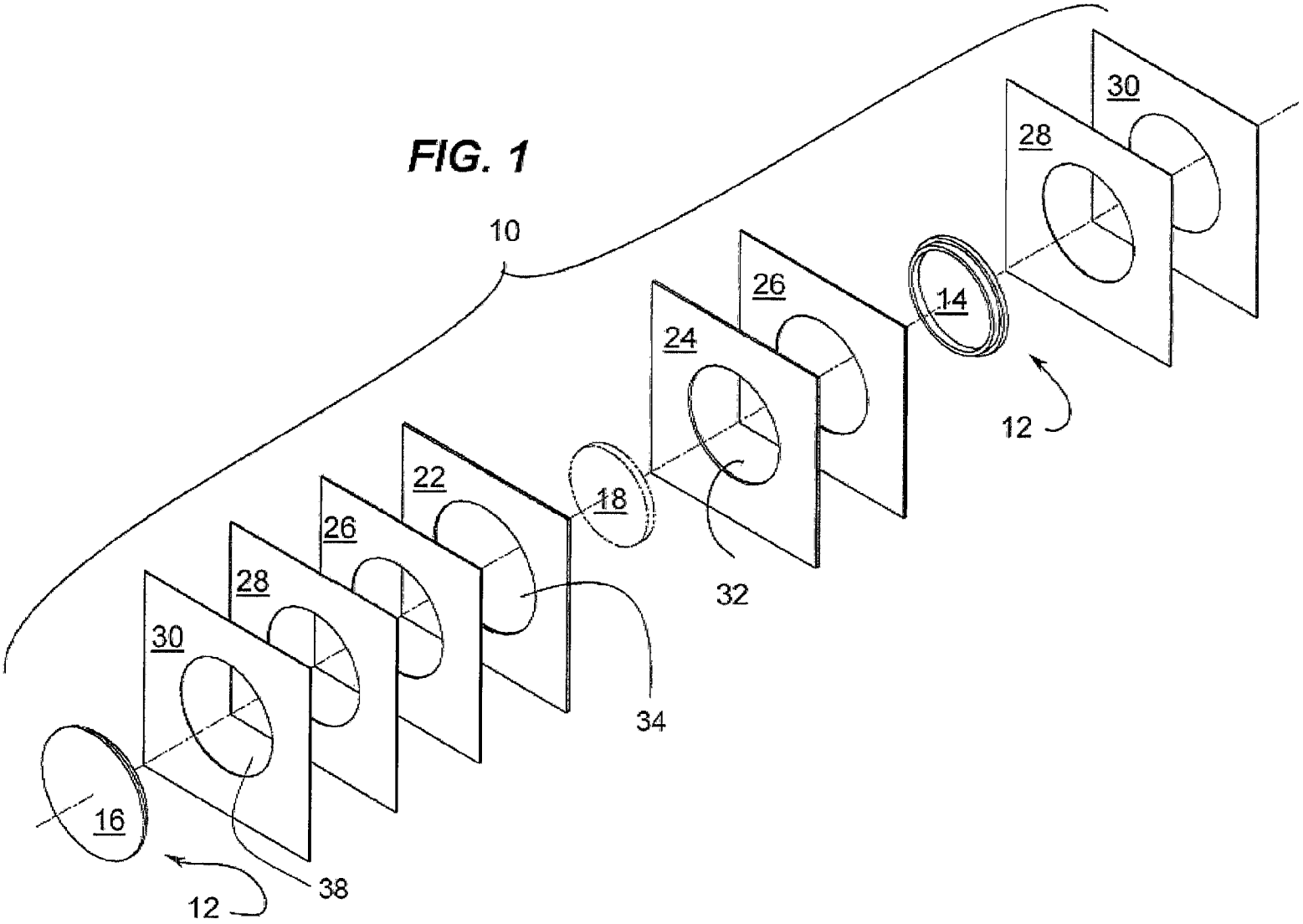
FIG. 1 is an exploded view of a display device in accordance with the present invention.

Referring to FIG. 1, the resealable packaging device comprises a capsule 12 having a base portion 14 and a cover 16 to display a collectible item 18, at least two padding layers 22 and 24, at least one covering film layers 26, at least one adhesive layer 28 and at least one cover layer 30.

Figure 2B:
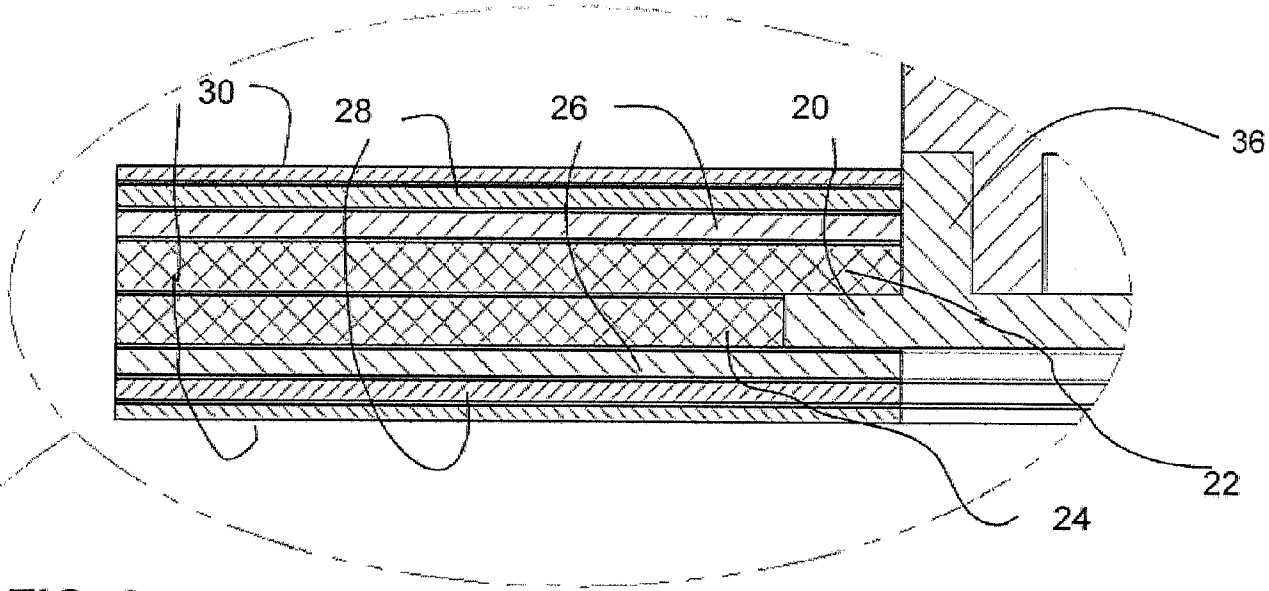
FIGS. 2*a* and 2*b* are a cutaway side view and a cutaway detail, respectively, of a display device in accordance with the present invention.
Figure 2A:
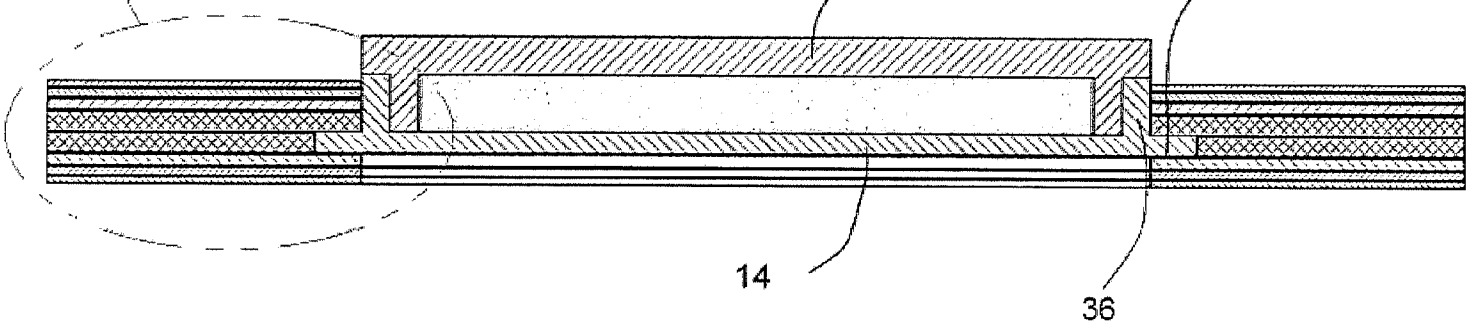
Figure 3:
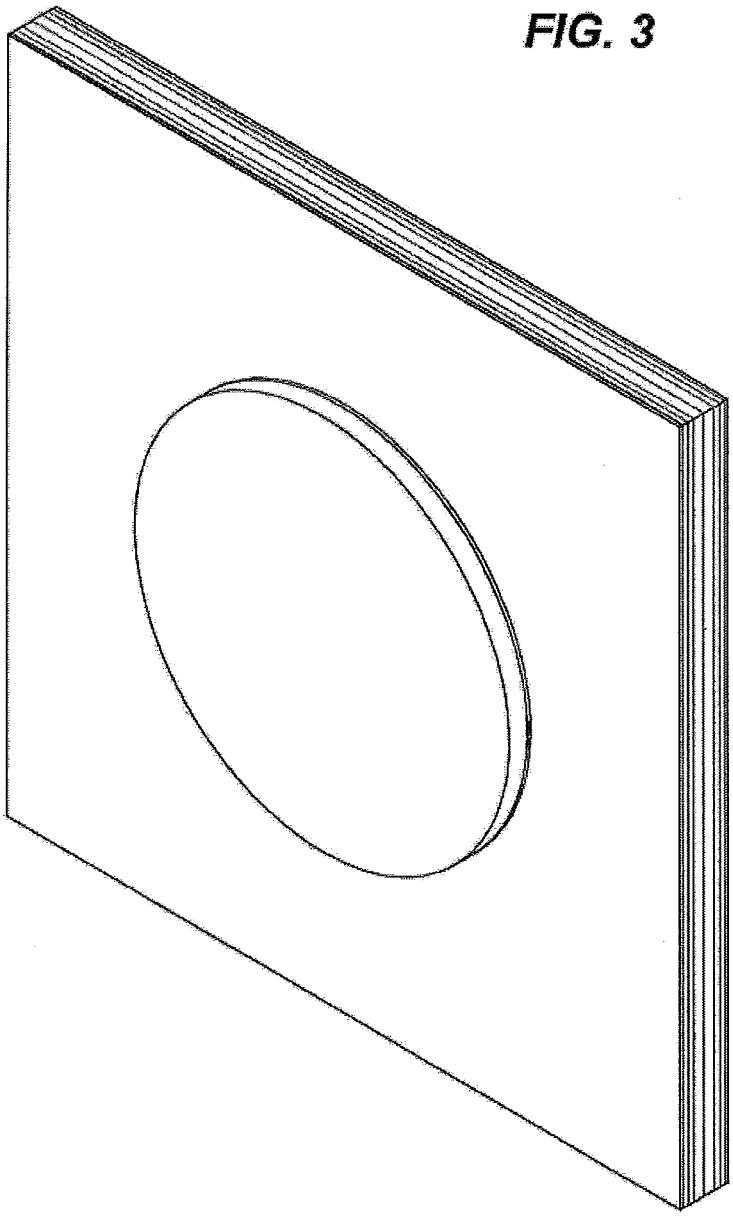
FIG. 3 is an isometric view of a display device in accordance with the present invention.
Figure 4B:
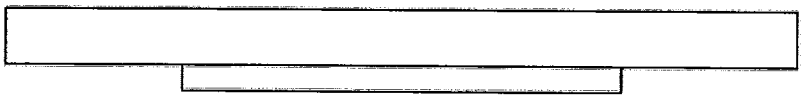
FIGS. 4*a* and 4*b* are front and side views, respectively, of a display device in accordance with the present invention.
Figure 4A:
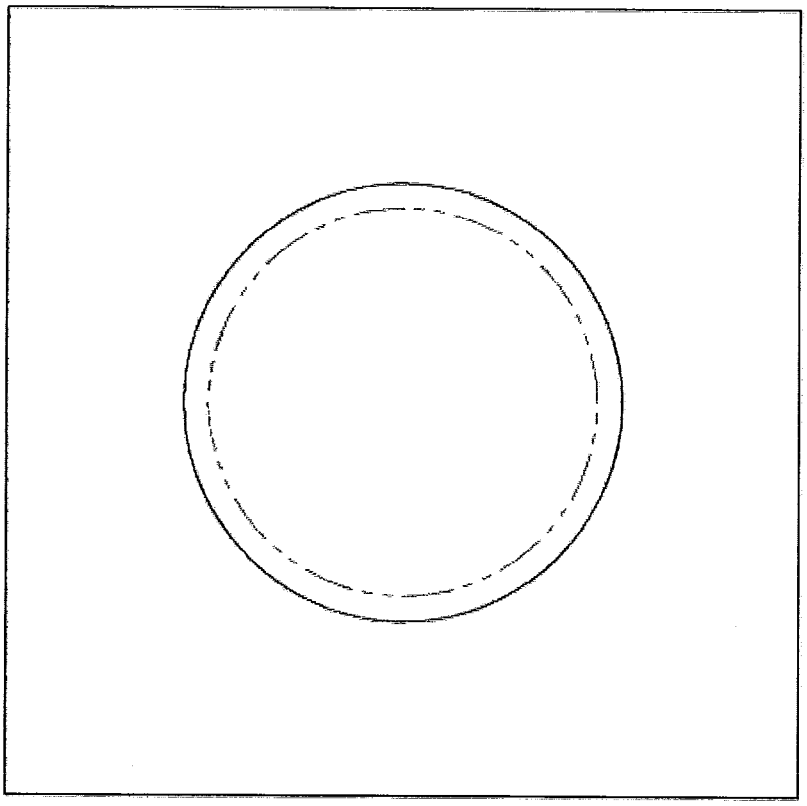

In the embodiment shown in FIGS. 1, 2*a* and 2*b*, the capsule 12 is made of generally transparent semi-rigid material such as, but not limited to, moulded high density styrene or acrylic, preferably crystal clear. The capsule 12 may be shaped as any given shape having any dimension. The support material is taken for the group of material including but not limited to polyester, polypropylene, cardboard or padding board.

The capsule 12 comprises two interlocking elements, a base portion 14 and a cover 16. The base portion 14 comprise a flange 20 and at least one side wall 36 keeping the at least one item 18 secured. The base portion 14 is moulded for the flange 20 to extend from the outer perimeter of the capsule 12. The cover 16 is shaped and dimensioned to be snapped or attached to the base portion 14 in order to seal the capsule 12. Preferably, the cover 16 comprises a groove portion made of two rims configured to be sealingly mounted on the side wall 36 of the base portion 14. Those skilled in the art shall notice that any engagement method allowing the cover 16 to seal the base portion 14 shall be used to mount the base portion 14 to the cover 16. In a preferred embodiment, the cover 16 may be removed any number of times from the base portion 14.

Although in the embodiment shown, the base portion 14 and the cover 16 are both transparent, in another embodiment (not shown) only one of the two needs to be transparent.

Still referring to FIGS. 1, 2*a* and 2*b*, the padding layers, the bottom layer 22 and top layer 24, are generally made of cardboard or any other semi-rigid material such polyester, polypropylene, any other semi-rigid plastic or polymer or flexible metal such as aluminum. Both padding layers 22 and 24 comprise at least one aperture 32 allowing the base portion 14 of the capsule 12 to be inserted. The aperture 34 of the bottom layer 22 is dimensioned and shaped to allow the peripheral delimitation and surface of the flange 20 of the capsule 12 to tightly fit into the aperture 34. The surface of the aperture 32 of the top layer 24 is generally inferior to the aperture 34 of the bottom layer 22 and is dimensioned and shaped to allow the peripheral delimitation and surface of the side wall 36 of the capsule 12 to tightly fit into the top layer 24 aperture 32. The bottom padding layer 22 thickness shall be same as the flange 20 thickness in order to provide a flat bottom surface of the packaging, thus creating a aesthetically looking package. The thickness of the top padding layer 24 shall be adapted to provide a flat top surface. To determine the thickness of the at least one top padding layer 24, one skilled in the art shall consider the thickness of the at least one cover layer 30, the thickness of the film layer 26, the height of the side wall 36, the thickness of the at least one adhesive layer 28 and the thickness of any other additional layer that may be required.

The at least two padding layers 22 and 24 are bonded or affixed together, using hot melt adhesives or any other sealing adhesive, in such a way that the apertures 32 and 34 are centrally aligned.

In another embodiment, the padding layers 22 and 24 are embodied as a single sheet of semi-rigid material being folded, thus creating a multilayer sheet wherein each layer is bonded to the other layers using adhesives as described above.

The at least covering film layer 26 is generally made of a polypropylene film (OPP) and is applied to the at least two padding layers 22 and 24 with an adhesive, preferably cold application adhesive. The top surface of the film layer 26 is coated with at least one adhesive layer 28.

The adhesive layer 28 is generally embodied as a heat activated adhesive. Thus, the film layer 26 creates a barrier to the adhesive layer 28, thus preventing the adhesive from being absorbed by the generally porous semi-rigid material of the padding layers 22 and 24. Such film layer 26 creating a barrier is required to maintain the bonding integrity of the packaging.

The at least one cover layer 30 allows the package 10 to be aesthetically attractive or to be informative as to print information on the at least one packaged item. The at least one cover layer 30 comprises at least one aperture 38 dimensioned and shaped to allow the cover 16 of the capsule 12 to be fitted. The at least one cover layer 30 is preferably made with cardboard but may be made with any other material allowing to be printed on. The at least one cover layer 30 is bonded or adhered to the padding board by applying heat and pressure in order in order to activate the heat-adhesive of the at least one film layer 26.

A method for packaging collectible items in accordance with the present invention comprises a step for bonding the at least two padding layers 22 and 24 together using a sealing adhesive, in such a way that the apertures 32 and 34 are centrally aligned.

The method further comprises a step of adding at least one covering film layer 26 by applying to the at least two padding layers 22 and 24 an adhesive and at least one covering film. Another step of the method is to push the base portion 14 of the capsule 12 through the bottom and top padding layers 22 and 24. As a result, the flange 20 of the base 14 will be held against the flange created by the smaller aperture 34 of the top padding layer 22 being centrally bonded to the aperture 34 of the bottom padding layer 24. This step allows the bottom portion 14 of the capsule 12 to be held in place.

The method comprises a further step for applying at least one adhesive layer 28 over the at least one film layer 26. Typically, a heat activated adhesive shall be applied. Then, the at least one cover layer is installed over the package by centrally aligning the at least one aperture 38 of the cover layer 30 with the at least one aperture 32 and 34 of the bonded padding layers 22 and 24. To bond the at least one cover layer 30 to the package, heat and pressure are applied on the at least one cover layer 30 in order in order to activate the heat-adhesive of the at least one film layer 26 and to heat seal the package 10.

Once the at least one cover layer 30 is heat sealed with the package, the at least one collectible item 18 may be inserted in the base portion 14 of the capsule 12 and the cover 16 may be snapped or secured in place through the at least one aperture 38 of the cover layer 30.

The method may comprise a step to die-cut or cut to any shape and size, prior to assembly, the at least one cover layer 30 and the at least two padding layers 22 and 24. Furthermore, the capsule may be moulded prior to the assembling of the resealable packaging device.

A method to use a resealable packaging device in accordance with the present invention comprises the steps of inserting an item 18 into the bottom portion 14 of the capsule 12 and to seal the capsule by snapping or securing the cover 16 through the at least one cover layer 30 aperture 38 where the capsule 12 is installed. The method to use a resealable packaging device may comprise the steps of removing the cover 16 of the sealed capsule 12 and for retrieving or accessing the item 18.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A packaging device for displaying at least one object, the packaging device comprising:

a) a capsule configured to display at least one object comprising:

i) a base portion comprising:

(1) a flange; and (2) at least one base side wall having an inside surface and an exterior surface, the inside surface keeping the at least one object secured;

ii) a cover made of transparent material;

the base portion and the cover being configured to be sealingly mounted together;

b) at least two padding layers each comprising at least one aperture for receiving the capsule, the padding layers having interior and exterior surfaces, the interior surfaces facing at least one surface of another padding layer and the exterior surfaces facing in a direction opposite to at least one other padding layer, a first of the padding layers abutting on exterior surfaces of the at least one base side wall;

c) at least two covering film layers, a first covering film layer being disposed on the exterior surface of the first padding layer and a second covering film layer being disposed on the exterior surface of a second padding layer;

d) at least two adhesive layers, each disposed over any of the at least two covering film layer;

e) at least two cover layers, each disposed over one of the adhesive layers;

the padding layers, the covering film layers, the adhesive layers and the cover layers being affixed together;

the base portion being tightly fitted in one of the aperture of the padding layers; and the flange of the base portion being in contact with at least one of the least two padding layer or at least one covering film layers.

2. A packaging device for displaying at least one object according to claim 1, wherein the at least two padding layers, the at least two covering film layers, the at least two adhesive layers and the at least two cover layers are bonded together in such a way that the at least one aperture of each layer having an aperture are centrally aligned.

3. A packaging device for displaying at least one object according to claim 2, wherein the base portion and the cover of the capsule are shaped and dimensioned to be sealingly yet removably mounted together.

4. A packaging device for displaying at least one object according to claim 1, the cover comprising at least one cover side wall, the at least one cover side wall being within the base portion and overlapping the inside surface of the at least one base side wall.

5. A packaging device for displaying at least one object according to claim 4, wherein when an object is located in the capsule, at least one of the at least one cover side wall is in between the at least one base side wall and the object.

6. A packaging device for displaying at least one object according to claim 4, wherein the base portion is made of transparent material.

7. A packaging device for displaying at least one object according to claim 4, wherein the at least two adhesive layers comprises heat activated adhesive.

8. A packaging device for displaying at least one object according to claim 7, wherein the at least two cover layers are made with a material allowing to be printed on.

9. A packaging device for displaying at least one object according to claim 1, wherein the at least two padding layers are made of semi-rigid material.

10. A packaging device for displaying at least one object according to claim 9, wherein the at least two covering film layers are made of a polypropylene film, wherein:

a) the covering film layers are each bonded to the at least two padding layers using an adhesive;

b) the top surface of the covering film layers are coated with one of the adhesive layers.

11. A packaging device for displaying at least one object according to claim 10, wherein the adhesive to applied to the covering film is cold application adhesive.

12. A packaging device for displaying at least one object according to claim 1, wherein the fitting of the base portion in one of the at least one aperture of the at least two padding layers is free of adhesive.

13. The packaging device for displaying at least one object according to claim 1, wherein the combined thickness of one padding layer, one covering film layer, one adhesive layer and one cover layer are at least the height of the base side wall.

14. A packaging device for displaying at least one object, the packaging device comprising :

a) a capsule comprising a base portion having a base side wall and a flange forming a lower periphery of the base portion, and a cover configured to display an object, wherein the base portion and the cover are configured to be sealingly yet removably mounted together and wherein the cover is made of transparent material;

b) two padding layers each comprising at least one aperture wherein:

i) the packaging device comprises two superposed padding layers, a bottom padding layer and a top padding layer;

ii) the aperture of the bottom padding layer is configured to allow the peripheral delimitation and the surface of the flange of the capsule to tightly fit into the aperture of the bottom padding layer;

iii) the two padding layers each comprise interior and exterior surfaces, the interior surface facing at least one surface of the other padding layer and the exterior surfaces facing in a direction opposite to the other padding layer, at least one of the two padding layers abutting on exterior surface of the base side wall;

c) the area of the aperture of the top padding layer being inferior than the aperture of the bottom layer;

d) at least two heat and pressure activated adhesive layers, each disposed over the exterior surface of each of the two padding layers;

e) at least two cover layers made with a material allowing to be printed on and disposed over each the at least two adhesive layers;

f) at least two polypropylene covering film layers each being disposed on the exterior surface of each of the two padding layers;

wherein the two padding layers, the at least two covering film layers, the at least two adhesive layers and the at least two cover layers are affixed together.

15. A packaging device for displaying at least one object according to claim 14, wherein the thickness of the top padding layer and of the bottom padding layer are adapted to the thickness of the flange in order to provide a flat bottom surface of the packaging.

16. The packaging device for displaying at least one object according to claim 14, wherein the combined thickness of one padding layer, one polypropylene covering film layer, one heat activated layer and one cover layer are at least the height of the base side wall.

17. A method of manufacturing a packaging device for packaging at least one object, the packaging device comprising a capsule having a base portion and a flange forming the lower periphery of the base portion, and a cover configured to display an object, two padding layers comprising one aperture, two covering film layers, two adhesive layers located between the at least one covering film layers and at least one of the two padding layers, and two cover layers, wherein the two padding layers, the two covering film layers, the two adhesive layers and the two cover layers are affixed together and wherein the method comprises the steps of:

centrally aligning the apertures of each padding layer;

bonding the two padding layers together using a sealing adhesive;

applying an adhesive to the two padding layers and to the two covering films layers;

centrally aligning the one aperture of the two cover layers with the aperture of the bonded padding layers;

bonding of the two cover layers to the bonded padding layers;

tightly fitting the base portion of the capsule in the aperture of the bonded padding layers until the flange of the capsule is tightly fitted into the aperture of the bottom padding layer and in contact with at least another padding layer;

removably securing the cover on the base through the aperture of one of the two cover layers where the base portion of the capsule is installed.

18. A method of manufacturing packaging device for packaging at least one object according to claim 17, wherein the bonding process for bonding the two cover layers to the bonded padding layers comprises the application of heat and pressure on the two cover layers to activate a heat-adhesive of the two film layers and to heat seal the packaging device.

19. A method of manufacturing a packaging device for packaging at least one object according to claim 18, wherein the method further comprises a step to cut the two cover layers and the two padding layers to any shape and size, prior to assembly.

20. The method of manufacturing a packaging device for packaging at least one object according to claim 17, wherein the combined thickness of one padding layer, one polypropylene covering film layer, one heat activated layer and one cover layer are at least the height of the base side wall.

* * * * *